US005534134A

United States Patent [19]

Roder et al.

[11] Patent Number: 5,534,134

[45] Date of Patent: Jul. 9, 1996

[54] LOW PAH PITCH AND PROCESS FOR SAME

[75] Inventors: William Roder, Indianapolis; Eric F. V. Scriven, Greenwood, both of Ind.

[73] Assignee: Reilly Industries, Inc., Indianapolis, Ind.

[21] Appl. No.: 156,240

[22] Filed: Nov. 23, 1993

[51] Int. Cl.$^6$ ..... C10C 3/00

[52] U.S. Cl. ..... 208/42; 208/22; 208/23

[58] Field of Search ..... 208/22, 23, 42

[56] References Cited

U.S. PATENT DOCUMENTS

| | | | |
|---|---|---|---|
| 3,644,240 | 2/1972 | Tarbell et al. | 260/4 R |
| 4,020,145 | 4/1977 | Soehngen et al. | 423/447.4 |
| 4,217,336 | 8/1980 | Maire et al. | 423/448 |
| 4,526,834 | 7/1985 | Mercuri et al. | 428/458 |
| 4,770,766 | 9/1988 | Keller et al. | 209/5 |
| 5,215,651 | 6/1993 | Yamamoto et al. | 208/126 |
| 5,266,184 | 11/1993 | Rodar | 208/22 |

OTHER PUBLICATIONS

Chemical Abstracts, vol. 110, No. 110:26536u, p. 15 (1989).
Chemical Abstracts, vol. 99, No. 99:72420d, p. 86 (1983).
Chemical Abstracts, vol. 99, No. 99:40064z, p. 87 (1983).
Chemical Abstracts, vol. 95, No. 95:28428f, p. 203 (1981).
Chemical Abstracts, vol. 94, No. 94:5696g, p. 107 (1981).
Chemical Abstracts, vol. 88, No. 88:193742s, p. 153 (1978).
Chemical Abstracts, vol. 83, No. 13111a, p. 168 (1975).
Chemical Abstracts, vol. 70, No. 5719v, p. 596 (1969).
Chemical Abstracts, vol. 98, No. 98:92227d, p. 156 (1963).
Chemical Abstracts, vol. 91, No. 91:109778q, p. 112, (1979).
Derwent Abstract of Japanese Patent No. 85011180.
Chemical Abstract, vol. 108, No. 108:224086u, pp. 134–135 (1988).

*Primary Examiner*—Helane Myers
*Attorney, Agent, or Firm*—Woodard, Emhardt, Naughton, Moriarty & McNett

[57] ABSTRACT

Described are preferred pitches which comprise a blend of coal tar pitch, petroleum pitch and gilsonite pitch, and preferred processes and compositions which can be used to form such pitches. The pitches have substantially reduced contents of polyaromatic hydrocarbons (PAH's) relative to standard coal tar pitches, and are thus more favorable from health, safety and environmental standpoints.

14 Claims, No Drawings

LOW PAH PITCH AND PROCESS FOR SAME

BACKGROUND OF THE INVENTION

The present invention resides generally in the field of tars and tar pitches. More specifically, the present invention relates to pitches which are useful in the production of anodes in the aluminum industry, and which have reduced levels of polyaromatic hydrocarbons (PAH's).

As further background, pitch resulting from the distillation of coal tar has long been used for many purposes. These include its use as a binder for carbon and graphite in the formation of carbon bodies and in the production of anodes, cathodes, electrodes, etc. for use in the metal industry. For example such electrodes are used in electrolytic reduction processes such as aluminium reduction.

Despite the historical use of coal tar pitch, in more recent years health concerns have been raised in connection with coal tar pitch. Coal tar contains a number of polyaromatic hydrocarbons, including anthracene, fluorene, phenanthrene, pyrene, fluoranthene, benz(a)anthracene, chrysene, benzo(b)fluoranthene, benzo(k)fluoranthene, benzo(a)pyrene, benzo(e)pyrene, dibenz(a,h)anthracene, benzo(g,h,i)perylene and indeno(1,2,3,c,d,)pyrene. Of these, the latter ten have been identified as having a carcinogenic or other toxic mature.

In light of this background, there is a need for new binder pitches which have reduced levels of PAH's, particularly those PAH's which are toxic. Such pitches would desirably retain the desirable physical characteristics of coal tar binder pitch, and be readily produced from abundant and readily available starting materials. The present invention addresses these needs.

SUMMARY OF THE INVENTION

The applicant has discovered a pitch which retains the desirable physical properties of coal tar pitch while having substantially reduced levels of PAH's, including the toxic PAH's. Accordingly, one preferred embodiment of the invention provides a pitch comprising a substantially homogeneous blend of coal tar pitch, gilsonite pitch and petroleum pitch.

Another preferred embodiment of the invention provides a process for producing a pitch with a reduced level of PAH's relative to coal tar pitch. The inventive process comprises the step of distilling a blend of (i) coal tar or coal tar pitch or a mixture thereof, (ii) petroleum tar or petroleum tar pitch or a mixture thereof, and (iii) gilsonite or gilsonite pitch or a mixture thereof, so as to obtain a pitch product. Advantageously, the blend will contain about 30–70% by weight of coal tar or coal tar pitch or a mixture thereof, about 5–30% by weight of gilsonite or gilsonite pitch or a mixture thereof, and about 5–70% by weight of petroleum tar or petroleum tar pitch or a mixture thereof. The relative amounts of (i), (ii) and (iii) chosen in the preferred processes provide a compatible or substantially homogeneous blend (i.e. substantially no separation of any of the three components is observed) so as to also achieve a substantially homogenous blend of materials in the resulting pitch.

Another preferred embodiment of the invention provides a composition which can be distilled ho form a pitch with a reduced level of PAH's relative to coal tar pitch. The composition of this embodiment comprises a blend of (i) coal tar or coal tar pitch or a mixture thereof, (ii) petroleum tar or petroleum tar pitch or a mixture thereof, and (iii) gilsonite or gilsonite pitch or a mixture thereof.

The embodiments of the invention thus provide pitches having reduced levels of PAH's as compared to pitch derived solely from coal tar. These inventive pitches are thus less toxic in nature, while retaining the valuable physical properties necessary for use as binders in constructing electrodes such as those used in the aluminum industry. As well, the pitches and compositions of the invention are made from abundant, inexpensive and readily available starting materials, and inventive processes of the invention can readily performed in conventional stills while not requiring complex or specialized processing steps to remove PAH's from coal tar.

These and other objects, features and advantages of the invention will be apparent from the following description.

DESCRIPTION OF THE PREFERRED EMBODIMENT

For the purposes of promoting an understanding of the principles of the invention, reference will now be made to certain embodiments thereof and specific language will be used to describe the same. It will nevertheless be understood that no limitation of the scope of the invention is thereby intended, such alterations and further modifications and applications of the principles of the invention as illustrated herein being contemplated as would normally occur to one skilled in the art to which the invention pertains.

As indicated above, the present invention provides modified pitches retaining the physical properties of coal tar pitch while having substantially reduced levels of PAH's, including reduced levels of those PAH's which are known to be toxic. Pitches of the invention can be achieved by distilling a blend of materials including coal tar or coal tar pitch or a mixture thereof, petroleum tar or petroleum tar pitch or a mixture thereof, and gilsonite or gilsonite pitch or a mixture thereof.

In this regard, the term coal tar is well known in the art, and refers to a liquid condensate which results from the destructive, dry distillation or carbonization of coal. Similarly, the terms petroleum tar and gilsonite are well known, and refer, respectively, to a liquid tar product resulting from the rectification of petroleum products, and to a natural asphaltite hydrocarbon substance which can be mined, for example, from the abundant gilsonite deposits found in the Uinita Basin in the northeast corner of Utah, U.S.A. A "pitch" of any of these substances refers, of course, to the material left behind (e.g. in the still) upon the distillation of the substance.

In preferred processes, the blend of the coal, petroleum and gilsonite based materials to be distilled will be compatible. That is, the blend will provide a substantially homogeneous mixture as opposed to one in which one or more of the components forms a separated layer. Such separated layers can lead to similarly separated layers in the resulting pitch product which detrimentally impact its quality when used, for example, as binder pitch.

Preferred blends will be comprised about 30–70% by weight of coal tar or coal tar pitch or a mixture thereof, about 5–30% by weight of gilsonite or gilsonite pitch or a mixture thereof, and about 5–70% by weight of petroleum tar or petroleum tar pitch or a mixture thereof. Even more preferred blends will be comprised about 30–70% by weight of coal tar or coal tar pitch or a mixture thereof, about 10–30% by weight of gilsonite or gilsonite pitch or a mixture thereof, and about 20–70% by weight of petroleum tar or petroleum tar pitch or a mixture thereof.

For ease in processing, it is further preferred that the blend to be distilled include at least about 20% by weight of tar (as opposed to pitch). This tar can be petroleum tar or coal tar or a mixture thereof. It is also more preferred to use gilsonite in its native form as opposed to using a gilsonite pitch, although it will of course be understood that either form will be suitable.

To form pitch in accordance with the invention, the blend of ingredients can be charged to a still, for instance a batch or continuous distillation still, and conventionally distilled to achieve a pitch. Such distillations can be performed as are distillations of pure coal tar, typically reaching maximum temperatures of about 360° C. when conducted at atmospheric pressures. Optionally, the blend can be reacted with formaldehyde prior to distillation so as to increase the yield of pitch obtained from the distillation, as disclosed in copending U.S. patent application Ser. No. 07/832,425 filed Feb. 7, 1992.

Once the distillation is complete, the resulting pitch residue can be conventionally recovered. The modified pitch product has good qualities, and its softening point will vary in accordance with several factors including the particular materials, levels of materials, and processing steps used. Preferred pitches will have softening points (Ring & Ball, ASTM D36) in the range of about 60° to about 150° C., more preferably about 100° to about 120° C. Such pitch products can be suitably used as binders in the formation of electrodes for use in the metal industry or in other conventional coal tar pitch applications. Likewise, the distillate oils from such distillations can be used, for example, as fuel oil or for lubricating purposes, or can be blended back into distillation charges for recycle.

The resulting pitch product has PAH levels which are substantially reduced as compared to those which would be obtained by using the coal tar alone. Relative to coal tar pitch, preferred pitches of the invention will have at least a 20% reduction (on a weight basis) in PAH content wherein the PAH's are selected from the group anthracene, fluorene, phenanthrene, pyrene, fluoranthene, benz(a)anthracene, chrysene, benzo(b)fluoranthene, benzo(k)fluoranthene, benzo(a)pyrene, benzo(e)pyrene, dibenz(a,h)anthracene, benzo(g,h,i)perylene and indeno(1,2,3,c,d,)pyrene (these are PAH's in binder pitch which volatilize during use of the pitch to form electrodes in the aluminum industry). In more preferred pitches, such reductions will be at least about 50%, and the above-listed PAH's will together comprise less than about 10% by weight of the pitch. Pitches of the invention are accordingly highly improved as compared to standard coal tar pitches, posing much lower risks from safety, health and environmental standpoints.

For the purpose of promoting a greater appreciation of the invention and its preferred aspects and embodiments, the following specific Examples are provided. It will be understood that these Examples are illustrative and not limiting of the invention.

In the Examples, certain abbreviations are used. These have their usual art recognized meaning unless otherwise indicated. For example, "g" means grams, °C. means degrees Celsius, % means percent and is based on weight unless otherwise indicated, QI=quinoline insolubles, etc. Softening Points were taken using the Ring & Ball test in accordance with ASTM D36. Specific Gravity was determined at 25° C.

EXAMPLE 1

To form a pitch in accordance with the invention, a blend of materials was charged to a batch still having one theoretical plate. The blend was comprised 60% of coal tar, 20% of gilsonite and 20% of petroleum tar. The blend was conventionally distilled to a temperature of 360° C. to result in a pitch product. The pitch product, which has properties making it useful as a binder pitch, was characterized as follows:

| | |
|---|---|
| Softening Point °C. | 110 |
| Yield, Weight % | 67.5 |
| Specific Gravity | 1.260 |
| QI % | 11.6 |
| Coking Value % | 55.3 |
| Ash % | 0.18 |
| Sulfur % | 0.90 |
| (a) Fluorene* | N/D |
| (b) Phenanthrene | 4713 |
| (c) Anthracene | 713 |
| (d) Pyrene | 6538 |
| (e) Fluoranthene | 5893 |
| (f) Benzo(a)anthracene | 3644 |
| (g) Chrysene | 5899 |
| (h) Benzo(e)pyrene | 2761 |
| (i) Benzo(a)pyrene | 4243 |
| (j) Benzo(b)fluoranthene | 3365 |
| (k) Benzo(k)fluoranthene | 2436 |
| (l) Dibenzo(a,h)anthracene | 1135 |
| (m) Benzo(g,h,i)perylene | 3783 |
| (n) Indeno(1,2,3,c,d)pyrene | 2323 |
| TOTAL (a)–(n) | 119836 |
| TOTAL (e)–(n) (toxic) | 92660 |
| % REDUCTION (a)-(n) | 60.4 |
| % REDUCTION (e)-(n) | 61.7 |

*PAH values are given in μg/g here and throughout Examples.
** % Reductions throughout are relative to standard coal tar pitch values, given immediately below.

This compares very favorably to a standard coal tar pitch, whose typical properties are as follows:

| | |
|---|---|
| Softening Point °C. | 112 |
| Yield, Weight % | 64.7 |
| Specific Gravity | 1.300 |
| QI % | 20.4 |
| Coking Value % | 58.6 |
| Ash % | 0.15 |
| Sulfur % | 0.60 |
| (a) Fluorene | N/D |
| (b) Phenanthrene | 8406 |
| (c) Anthracene | 2379 |
| (d) Pyrene | 16390 |
| (e) Fluoranthene | 17880 |
| (f) Benzo(a)anthracene | 8837 |
| (g) Chrysene | 12780 |
| (h) Benzo(e)pyrene | 6776 |
| (i) Benzo(a)pyrene | 10640 |
| (j) Benzo(b)fluoranthene | 7723 |
| (k) Benzo(k)fluoranthene | 8792 |
| (l) Dibenzo(a,h)anthracene | 3358 |
| (m) Benzo(g,h,i)perylene | 7014 |
| (n) Indeno(1,2,3,c,d)pyrene | 8860 |
| TOTAL (a)–(n) | 119836 |
| TOTAL (e)–(n) (toxic) | 92660 |

EXAMPLE 2

The distillation procedure of Example 1 was repeated, except the blend charged to the still was comprised 39% of coal tar, 19% of gilsonite, 19% of petroleum tar and 23% of petroleum pitch. The resulting pitch product was characterized as follows:

| | |
|---|---|
| Softening Point °C. | 110 |
| Yield, Weight % | 66.9 |

-continued

| | |
|---|---|
| QI % | 7.6 |
| Coking Value % | 54.1 |
| Ash % | 0.15 |
| Sulfur % | 1.0 |
| (a) Fluorene | N/D |
| (b) Phenanthrene | 1315 |
| (c) Anthracene | 194 |
| (d) Pyrene | 8063 |
| (e) Fluoranthene | 4825 |
| (f) Benzo(a)anthracene | 3335 |
| (g) Chrysene | 5287 |
| (h) Benzo(e)pyrene | 3798 |
| (i) Benzo(a)pyrene | 3866 |
| (i) Benzo(b)fluoranthene | 2184 |
| (k) Benzo(k)fluoranthene | 2338 |
| (l) Dibenzo(a,h)anthracene | 1176 |
| (m) Benzo(g,h,i)perylene | 3140 |
| (n) Indeno(1,2,3,c,d)pyrene | 2406 |
| TOTAL (a)-(n) | 41927 |
| TOTAL (e)-(n) (toxic) | 32355 |
| % REDUCTION (a)-(n) | 65 |
| % REDUCTION (e)-(n) | 65.1 |

EXAMPLE 3

The distillation procedure of Example 1 was repeated, except the blend charged to the still was comprised 35% of coal tar pitch, 12% of gilsonite, 23% of petroleum pitch and 23% of ethylene cracker tar (a type of petroleum tar). The resulting pitch product was characterized as follows:

| | |
|---|---|
| Softening Point °C. | 113 |
| Yield, Weight % | 85.8 |
| Specific Gravity | 1.263 |
| QI % | 8.6 |
| Coking Value % | 54.5 |
| Ash % | 0.10 |
| Sulfur % | 0.30 |
| (a) Fluorene | 935 |
| (b) Phenanthrene | 4124 |
| (c) Anthracene | 624 |
| (d) Pyrene | 4764 |
| (e) Fluoranthene | 3527 |
| (f) Benzo(a)anthracene | 2283 |
| (g) Chrysene | 3720 |
| (h) Benzo(e)pyrene | 1675 |
| (i) Benzo(a)pyrene | 2292 |
| (j) Benzo(b)fluoranthene | 3469 |
| (k) Benzo(k)fluoranthene | N/D |
| (l) Dibenzo(a,h)anthracene | 945 |
| (m) Benzo(g,h,i)perylene | 2639 |
| (n) Indeno(1,2,3,c,d)pyrene | 1706 |
| TOTAL (a)-(n) | 32730 |
| TOTAL (e)-(n) (toxic) | 22283 |
| % REDUCTION (a)-(n) | 72.7 |
| % REDUCTION (e)-(n) | 76 |

EXAMPLE 4

The distillation procedure of Example 1 was repeated, except the blend charged to the still was comprised 50% of coal tar pitch, 20% of gilsonite and 30% of petroleum tar. The resulting pitch product was characterized as follows:

| | |
|---|---|
| Softening Point °C. | 110 |
| Yield, Weight % | 84.9 |
| Specific Gravity | 1.251 |
| QI % | 12.4 |
| Coking Value % | 54.1 |
| Ash % | 0.16 |
| Sulfur % | 0.80 |
| (a) Fluorene | N/D |

-continued

| | |
|---|---|
| (b) Phenanthrene | 194 |
| (c) Anthracene | N/D |
| (d) Pyrene | 3677 |
| (e) Fluoranthene | 2673 |
| (f) Benzo(a)anthracene | 3282 |
| (g) Chrysene | 5434 |
| (h) Benzo(e)pyrene | 2843 |
| (i) Benzo(a)pyrene | 4414 |
| (j) Benzo(b)fluoranthene | 3469 |
| (k) Benzo(k)fluoranthene | 2646 |
| (l) Dibenzo(a,h)anthracene | 1491 |
| (m) Benzo(g,h,i)perylene | 3985 |
| (n) Indeno(1,2,3,c,d)pyrene | 2774 |
| TOTAL (a)-(n) | 36882 |
| TOTAL (e)-(n) (toxic) | 33011 |
| % REDUCTION (a)-(n) | 69.2 |
| % REDUCTION (e)-(n) | 64.4 |

All publications or patent applications cited herein are hereby incorporated by reference in their entirety as if each had been individually incorporated by reference and fully set forth.

While the invention has been illustrated and described in detail in the foregoing description, the same is to be considered as illustrative and not restrictive in character, it being understood that only the preferred embodiment has been described and that all changes and modifications that come within the spirit of the invention are desired to be protected.

What is claimed is:

1. A pitch product, comprising a pitch including a substantially homogeneous blend of coal tar pitch, gilsonite pitch and petroleum pitch, said pitch being substantially free from separated layers containing coal tar pitch, gilsonite pitch or petroleum pitch and having a Ring and Ball (ASTM D36) softening point of about 60° C. to about 150° C.

2. The pitch of claim 1 which has a Ring and Ball (ASTM D36) softening point of about 60° to about 120° C., and which is formed by the distillation of a bituminous blend including (i) coal tar or coal tar pitch or a mixture thereof; (ii) petroleum tar or petroleum tar pitch or a mixture thereof; and (iii) gilsonite or gilsonite pitch or a mixture thereof, to obtain a pitch product.

3. The pitch of claim 2 which has a Ring and Ball (ASTM D36) softening point of about 100° C. to about 120° C.

4. The pitch of claim 1 wherein the weight percent of polyaromatic hydrocarbons in the pitch selected from the group anthracene, fluorene, phenanthrene, pyrene, fluoranthene, benz(a)anthracene, chrysene, benzo(b)fluoranthene, benzo(k)fluoranthene, benzo(a)pyrene, benzo(e)pyrene, dibenz(a,h)anthracene, benzo(g,h,i)perylene and indeno(1,2,3,c,d,)pyrene, is at least 20% reduced relative to the coal tar pitch alone.

5. The pitch of claim 3 wherein the weight percent of polyaromatic hydrocarbons in the binder pitch selected from the group anthracene, fluorene, phenanthrene, pyrene, fluoranthene, benz(a)anthracene, chrysene, benzo(b)fluoranthene, benzo(k)fluoranthene, benzo(a)pyrene, benzo(e)pyrene, dibenz(a,h)anthracene, benzo(g,h,i)perylene and indeno(1,2,3,c,d,)pyrene, is at least 20% reduced relative to the coal tar pitch alone.

6. The pitch of claim 4 wherein the weight percent of said polyaromatic hydrocarbons in the binder pitch is at least 50% reduced relative to the coal tar pitch alone.

7. The pitch of claim 5 wherein the weight percent of said polyaromatic hydrocarbons in the binder pitch is at least 50% reduced relative to the coal tar pitch alone.

8. A process for producing a pitch with a reduced level of polyaromatic hydrocarbons relative to coal tar pitch, comprising:

distilling a blend of (i) coal tar or coal tar pitch or a mixture thereof; (ii) petroleum tar or petroleum tar pitch or a mixture thereof, and (iii) gilsonite or gilsonite pitch or a mixture thereof, to obtain a pitch product.

9. The process of claim 8 wherein the blend is about 30–70% by weight comprised of coal tar or coal tar pitch or a mixture thereof.

10. The process of claim 9 wherein the blend is about 5–30% comprised of gilsonite or gilsonite pitch or a mixture thereof.

11. The process of claim 10 wherein the blend is about 5–70% comprised of petroleum tar or petroleum tar pitch or a mixture thereof.

12. The process of claim 11 wherein the pitch product has a Ring and Ball (ASTM D36) softening point of about 100° C. to about 120° C., and with the proviso that said blend prior to said distilling is comprised at least about 20% of tar.

13. The process of claim 12 wherein the weight percent of polyaromatic hydrocarbons in the pitch product selected from the group anthracene, fluorene, phenanthrene, pyrene, fluoranthene, benz(a)anthracene, chrysene, benzo(b)fluranthene, benzo(k)fluoranthene, benzo(a)pyrene, benzo(e)pyrene, dibenz(a,h)anthracene, benzo(g,h,i)perylene and indeno(1,2,3,c,d,)pyrene, is at least 20% reduced relative to that which would be obtained using the coal tar alone.

14. The process of 13 wherein the pitch product is less than about 10% comprised of polyaromatic hydrocarbons selected from the group anthracene, fluorene, phenanthrene, pyrene, fluoranthene, benz(a)anthracene, chrysene, benzo(b-)fluoranthene, benzo(k)fluoranthene, benzo(a)pyrene, benzo(e)pyrene, dibenz(a,h)anthracene, benzo(g,h,i)perylene and indeno(1,2,3,c,d,)pyrene.

* * * * *